US007556262B2

(12) United States Patent
Mizuno

(10) Patent No.: US 7,556,262 B2
(45) Date of Patent: Jul. 7, 2009

(54) PAPER SHEET ACCUMULATING/FEEDING APPARATUS

(75) Inventor: Sho Mizuno, Ohtsu (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 12/027,331

(22) Filed: Feb. 7, 2008

(65) Prior Publication Data

US 2008/0136089 A1 Jun. 12, 2008

Related U.S. Application Data

(63) Continuation of application No. 11/070,246, filed on Mar. 3, 2005, now Pat. No. 7,380,784.

(30) Foreign Application Priority Data

Mar. 4, 2004 (JP) ..... 2004-059967

(51) Int. Cl.
*B65H 31/00* (2006.01)

(52) U.S. Cl. ..... 271/207; 271/220; 271/213

(58) Field of Classification Search ..... 271/220, 271/213, 207, 3.12, 178
See application file for complete search history.

(56) References Cited

U.S. PATENT DOCUMENTS 3,847,388 A * 11/1974 Lynch ..... 271/306
4,589,654 A * 5/1986 Kanoto ..... 271/314
4,883,265 A 11/1989 Iida
4,988,087 A * 1/1991 Sardano et al. ..... 271/314
5,692,740 A 12/1997 Holtje
7,243,914 B2 7/2007 Tokunaga et al.

FOREIGN PATENT DOCUMENTS

| | | |
|---|---|---|
| JP | 06-263303 | 9/1994 |
| JP | 07-257805 | 10/1995 |
| JP | 2003-171068 | 6/2003 |
| JP | 2004-137015 A | 5/2004 |
| JP | 2004137015 A * | 5/2004 |
| WO | WO 84/02327 | 6/1984 |

* cited by examiner

*Primary Examiner*—Kaitlin S Joerger
(74) *Attorney, Agent, or Firm*—Brundidge & Stanger, P.C.

(57) ABSTRACT

A paper sheet accumulating/feeding apparatus to execute an accumulating processing, in which paper sheets conveyed by a conveyance unit are accumulated in an accumulating unit in a direction of accumulation, and a feeding processing, in which paper sheets accumulated in the accumulating unit are fed to the conveyance unit, comprising a rotating member including one or more pieces, which spread radially from an axis thereof, the rotating member being provided in the vicinity of a connection between the conveyance unit and the accumulating unit to enable the piece or pieces to slap and move a paper sheet in the accumulating unit in the direction of accumulation at the time of accumulating processing, and a guide member provided to guide the piece or pieces to enable the same to be stored toward the axis of the rotating member, whereby the paper sheet accumulating/feeding apparatus is able to readily set the piece or pieces long and endures an operation over a long term and frequent operations.

8 Claims, 10 Drawing Sheets

PAPER SHEET ACCUMULATING/FEEDING APPARATUS

This application is a continuation of U.S. application Ser. No. 11/070,246, filed Mar. 3, 2005 now U.S. Pat. No. 7,380, 784, now allowed, the entirety of which is incorporated herein by reference.

BACKGROUND OF THE INVENTION

The present invention relates to a paper sheet accumulating/feeding apparatus that performs an accumulating processing and a feeding processing on paper sheets in a manner to accumulate paper sheets, such as notes, etc, in an accumulating section from a conveyance path in the accumulating processing such as receipt processing, etc. and to feed paper sheets onto the conveyance path from the accumulating section in the feeding processing such as payment processing, etc., a rotating member, and a guide member.

Conventionally, paper sheet accumulating/feeding apparatuses capable of accumulating/feeding of paper sheets comprise an impeller to slap down a paper sheet into a storage section in order to allow paper sheets being accumulated in an accumulating action to avoid collision against succeeding paper sheets, as shown in Patent Gazette No. 2908169.

Such impeller obstructs feeding when paper sheets are to be fed. Therefore, that construction is general, in which the impeller is mounted to a tip end of an arm that turns on a pivot, and the arm turns at the time of feeding action to withdraw the impeller.

Such construction is complicated because of the need for a drive unit that moves the impeller. Thus there are caused problems to lead to an increase in cost and a decrease in operating ratio, caused by failure generation and maintenance for prevention of failure.

The applicant of the present application has proposed a paper sheet accumulating/feeding apparatus of simple construction using a rotating member provided with pieces that spread substantially radially from a folded state due to centrifugal forces so as to enable a slapping action of and withdrawal of an impeller (JP-A-2003-171068).

However, there is involved a problem that while it is necessary to set a length of pieces long in case of accumulating notes having a large size and in case of enabling accumulating notes having different sizes, it is difficult to set a length of pieces long in that construction, in which the pieces are caused by centrifugal forces to spread substantially radially from a folded state as described above. Specifically, with the example described above, in order to maintain a folded state of the pieces in a stationary state and to sufficiently spread the pieces in a rotating state, it is difficult to well balance elastic forces of materials, thicknesses of the pieces, and the like. Also, there is involved a problem that the pieces are gradually deformed plastically in use over a long term to be decreased in those forces, which cause restoration to the folded state.

SUMMARY OF THE INVENTION

It is an object of the invention to provide a paper sheet accumulating/feeding apparatus that is simple in construction and can effectively accumulate notes having a large size and accumulate/feed notes having different sizes.

Further, in view of the problems described above, it is an object of the invention to provide a paper sheet accumulating/feeding apparatus that can readily set pieces long and endures an operation over a long term and frequent operations, a rotating member, and a guide member.

In order to attain the object, the invention provides a paper sheet accumulating/feeding apparatus including an accumulating unit that accumulates a paper sheet or sheets, and an accumulating/feeding unit arranged between a paper sheet conveyance path outside the apparatus and the accumulating unit to perform a storage processing and a feeding processing on a paper sheet or sheets, the accumulating/feeding unit comprising a rotating member including one or more pieces, which spread radially from an axis thereof and are made of a member, at least a part of which is flexible, as the rotating member rotates at the time of accumulating processing, the rotating member slapping the paper sheet in a direction, in which the paper sheet is accumulated in the accumulating unit, to accumulate the paper sheet, and a guide member that guides the piece or pieces to suppress radial spread of the piece or pieces at the time of feeding processing.

With such constitution, it is possible in a simple construction to cause the piece or pieces to slap down a paper sheet in the accumulating processing to store and arrange the same and to cause the guide member to store and withdraw the piece or pieces in a manner to prevent the piece or pieces from getting in the way at the time of feeding processing. Thereby, it is possible to provide a paper sheet accumulating/feeding apparatus, which can readily set the piece or pieces long and endures an operation over a long term and frequent operations, a rotating member, and a guide member. Also, the piece or pieces of the rotating member can exactly slap down a paper sheet even in the case where a paper sheet accumulating/feeding apparatus is constructed to mix and accumulate paper sheets having different sizes.

More specifically, the invention has a feature in a paper sheet accumulating/feeding apparatus to execute an accumulating processing, in which paper sheets conveyed by a conveyance unit are accumulated in an accumulating unit in a direction of accumulation, and a feeding processing, in which paper sheets accumulated in the accumulating unit are fed to the conveyance unit, the apparatus comprising a rotating member, which includes one or more deformable pieces to spread radially from an axis thereof, and is provided in the vicinity of a connection between the conveyance unit and the accumulating unit to enable the piece or pieces to slap and move a paper sheet in the accumulating unit in the direction of accumulation at the time of accumulating processing, a guide member provided to guide the piece or pieces to enable the same to be stored toward the axis of the rotating member, and movable means that can move the guide member in a manner to store the piece or pieces at the time of feeding processing.

The paper sheet includes a note, a card, paper, and printed paper. The piece or pieces of the rotating member are formed from an elastic member, which includes a resin member such as a deformable rubber material, etc, or a deformable, metallic member such as a deformable, elastic steel sheet, etc., or formed from a deformable structure that moves pivotally at a base thereof toward the rotating member, or at an intermediate portion between the base and a tip end thereof to be able to fold or bend in a direction of rotation.

Also, the piece or pieces are formed from a plate-shaped body or a filmy body, which is formed to have predetermined width, thickness and length, or a cord-shaped body, which is formed to have a predetermined thickness. Further, in case of being formed from a plate-shaped body, or a filmy body, the body is shaped to be constant in width, thickness, and length, or tapered to be increased in thickness toward a tip end thereof, or tapered to be increased in width toward a tip end thereof, or formed to have a weight on a side toward a tip end thereof to have a center of gravity on the tip end side. Further, in case of being formed from a cord-shaped body, the body is shaped to be constant in thickness, or tapered to be increased in thickness toward a tip end thereof, or formed to have a weight on a side toward a tip end thereof to have a center of gravity on the tip end side.

The rotating member is formed from a roller (or a vane-roller) having one or more pieces, or a rotating shaft (or a vane-shaft) having one or more pieces.

The construction for slap and movement in the accumulating unit in the direction of accumulation includes one, in which a tip end or/and an intermediate portion of the piece or pieces slaps and move the paper sheet. Also, the construction for slap and movement includes one, in which a paper sheet is slapped down and moved downward in case of loading a paper sheet horizontally, and one, in which a paper sheet is slapped down and moved laterally in case of causing paper sheets in a vertical position to be stacked and accumulated laterally.

The guide member is composed of a metallic member of aluminum, stainless steel, iron, or the like, or a resin member of plastics or the like.

The movable means is composed of bias means, such as spring, rubber, etc, which biases the guide member in a predetermined direction, or drive means, such as motor, solenoid, etc., which moves or turns the guide member in a predetermined direction.

According to an embodiment of the invention, the movable means is composed of bias means, which biases the guide member toward the rotating member, the guide member is moved outside the rotating member by torque of the piece or pieces of the rotating member at the time of accumulating processing, and the piece or pieces of the rotating member can be stored by the bias of the bias means at the time of feeding processing.

The bias means is formed from a spring, such as coil spring, spiral spring, leaf spring, etc., which is formed from a molding of a metallic member, plastic member, etc., or an elastic member of rubber, etc. With such construction, the bias means can be composed of an inexpensive member to achieve reduction in cost.

Also, according to an embodiment of the invention, the movable means is formed from a shaft member that pivotally supports the guide member, and bias means that biases a guide portion of the guide member in a direction, in which the guide portion is turned toward the rotating member about an axis of the shaft member, so that at the time of accumulating processing, the shaft member and the guide portion can be arranged in the positional relationship to be directed so that the piece or pieces contact with the guide portion earlier than the shaft member does.

The shaft member is composed of a member, which functions as a rotating shaft, such as a pin formed from a rod-shaped member, support projections rotatably interposing and supporting the guide member at both ends thereof, etc.

The guide portion is composed of an end of or/and that surface of an intermediate portion of the guide member, which faces the rotating member.

With such construction, it is possible in a simple design to realize slapping down a note at the time of accumulation and withdrawing the piece or pieces at the time of feed.

Also, according to an embodiment of the invention, the guide member can be formed from a plate-shaped body curved or bent substantially arcuately with a side thereof toward the rotating member being concave.

The plate-shaped body is formed from a single plate-shaped body opposed to the piece or pieces of the rotating member, or a plurality of plate-shaped bodies corresponding to respective pieces in the case where the pieces of the rotating member are arranged in plural number in an axial direction of the rotating member.

With such construction, it is possible to efficiently and exactly carry out slapping-down of a paper sheet at the time of accumulating processing and storage of the piece or pieces at the time of feeding processing.

Also, according to an embodiment of the invention, an elevating base is provided in the accumulating unit to be able to load paper sheets to ascend and descend, and it is possible to execute a piece storage processing, in which the rotating member is rotated in a direction of feed to allow the piece or pieces of the rotating member to be stored when the elevating base acts to ascend.

The elevating base is formed from a base, such as a presser plate, etc., which vertically moves paper sheets loaded thereon. With such construction, it is possible to prevent the piece or pieces of the rotating member from obstructing an ascending action of the elevating base.

Also, the invention can comprise a rotating member used for the paper sheet accumulating/feeding apparatus. Thereby, the rotating member can be mounted on a paper sheet accumulating/feeding apparatus to be used.

Also, the invention can comprise a guide member used for the paper sheet accumulating/feeding apparatus. Thereby, the guide member can be mounted on a paper sheet accumulating/feeding apparatus to store the piece or pieces.

Other objects, features and advantages of the invention will become apparent from the following description of the embodiments of the invention taken in conjunction with the accompanying drawings.

DESCRIPTION OF THE PREFERRED EMBODIMENTS

Figure 1:
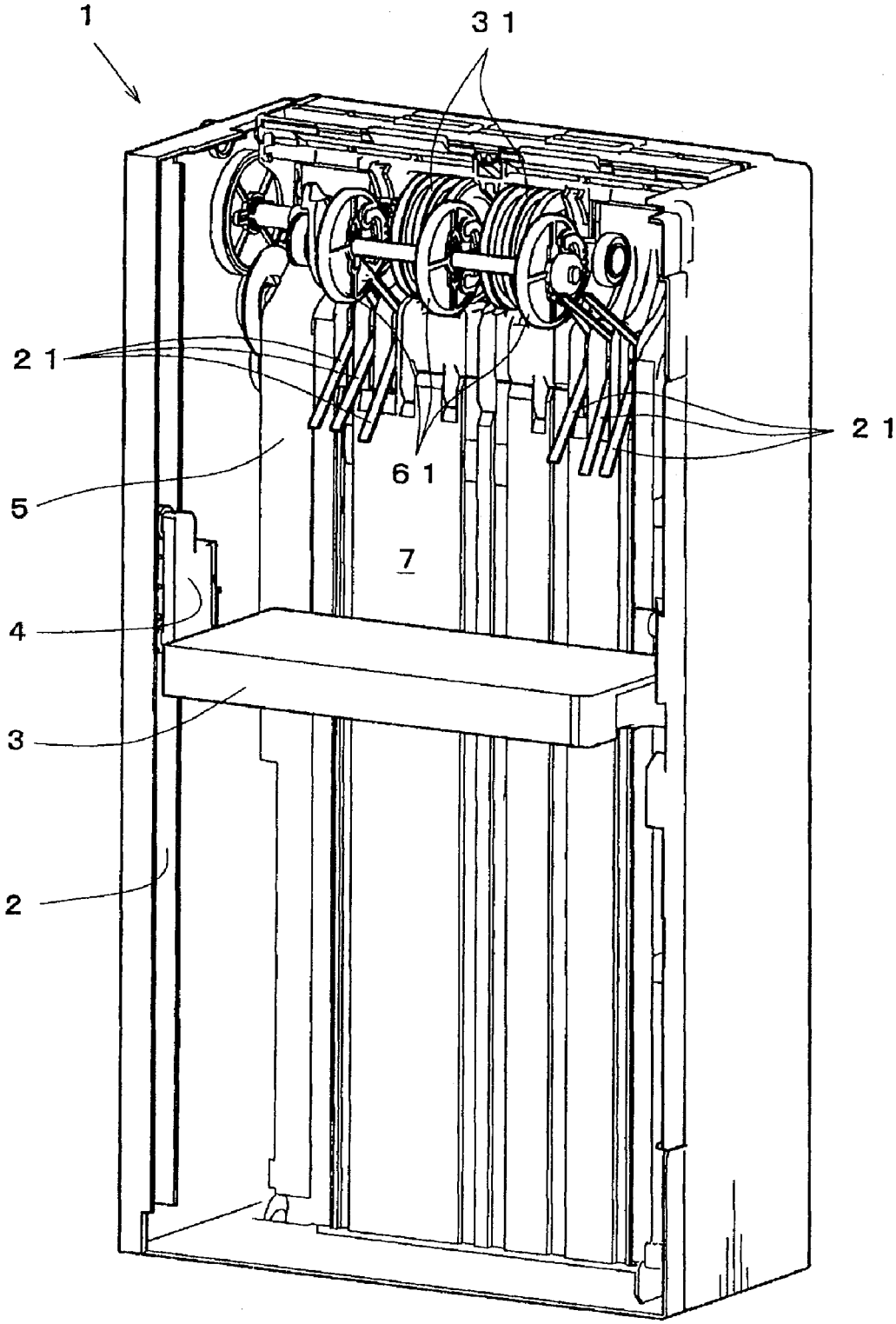
FIG. 1 is a perspective view showing a note accumulating/feeding apparatus.

An embodiment of the invention will be described below with reference to the drawings. First, an external appearance and a construction of a note accumulating/feeding apparatus 1 will be described with reference to a perspective view of the note accumulating/feeding apparatus 1 in a state, in which a front panel is removed as shown in FIGS. 1 and 2.

The note accumulating/feeding apparatus 1 is formed to have a box-shaped appearance, and comprises an accumulation space 7, in which notes are stacked therein in a horizontal position and an elevating plate 3 of a note size (a size corresponding substantially to that of a note) provided on a bottom of the accumulation space 7.

The elevating plate 3 is provided with an elevation drive device 4 that moves up and down along a vertical movement groove 2. The elevation drive device 4 is provided therein with a reversible motor (pulse motor), and forward and rearward rotation control of the reversible motor (pulse motor) by appropriate control means causes the elevation drive device to move up and down along the vertical movement groove 2. The elevation drive device 4 enables the elevating plate 3 to move up and down while kept in a horizontal state.

Figure 2:
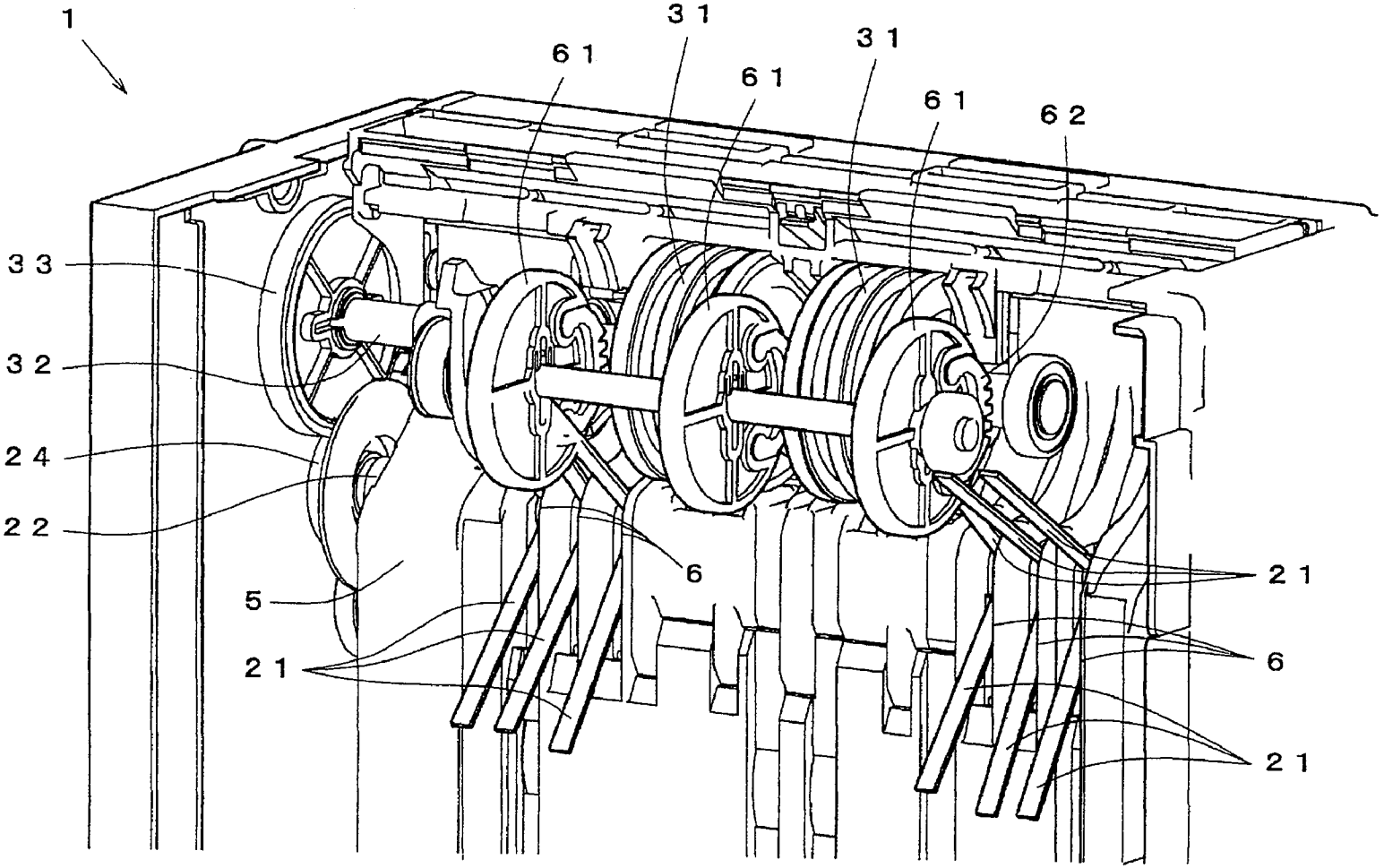
FIG. 2 is an enlarged, perspective view showing a part of the note accumulating/feeding apparatus.

As shown in a partly enlarged view of FIG. 2, a feed shaft 32 is mounted and born transversely in an upper portion of the note accumulating/feeding apparatus 1, and two feed rollers 31, 31 in the form of a substantially round column are fittingly mounted at a predetermined interval on the feed shaft 32. The feed rollers 31 convey, along a note conveyance guide 5, which defines one surface of a conveyance path, notes to a side of the accumulation space 7 at the time of accumulation and upward at the time of feed.

A gear, of which illustration is omitted, is fittingly mounted on one right end of the feed shaft 32, and torque of a reversible motor, of which illustration is omitted, can serve as a drive force through the gear. In addition, forward and rearward rotation of the reversible motor is controlled by appropriate control means.

Also, one right end of a shaft 22 is born by a positioning plate (of which illustration is omitted) outside the accumulation space 7, and the end (of which illustration is omitted) is positioned along with the feed shaft 32, which is likewise born by the positioning plate.

A gear 33 is fittingly mounted on the other left end of the feed shaft 32 to transmit a drive force to the shaft 22, which is mounted downwardly of and this side of the feed shaft 32, through a gear 24.

The shaft 22 is provided with impellers 21 and gate rollers described later. Also, provided this side of the feed rollers 31 are three pickup rollers 61, which comprise a projection 62 made of a rubber material (resin member) to pick up a paper sheet at the time of feeding processing.

Grooves 6 are provided three by three on the right and left of the note conveyance guide 5, and rotating pieces 21*a* of the impellers 21 are allowed to project from the grooves 6.

With such construction, the feed rollers 31 convey notes along the note conveyance guide 5 at the time of accumulating processing to enable accumulating the notes in the accumulation space 7. At the time of feeding processing, the elevation drive device 4 lifts the elevating plate 3 and the pickup rollers 61 can feed notes one by one along the note conveyance guide 5.

Subsequently, referring to FIG. 3 being a front view showing an accumulating/feeding auxiliary device 20 composed of the shaft 22 and its peripheral parts, FIG. 4 being an exploded, perspective view showing the accumulating/feeding auxiliary device 20, and FIG. 5 being a cross sectional view showing the accumulating/feeding auxiliary device 20, an explanation will be given to the accumulating/feeding auxiliary device 20 mounting thereon the impellers 21.

Figure 3:
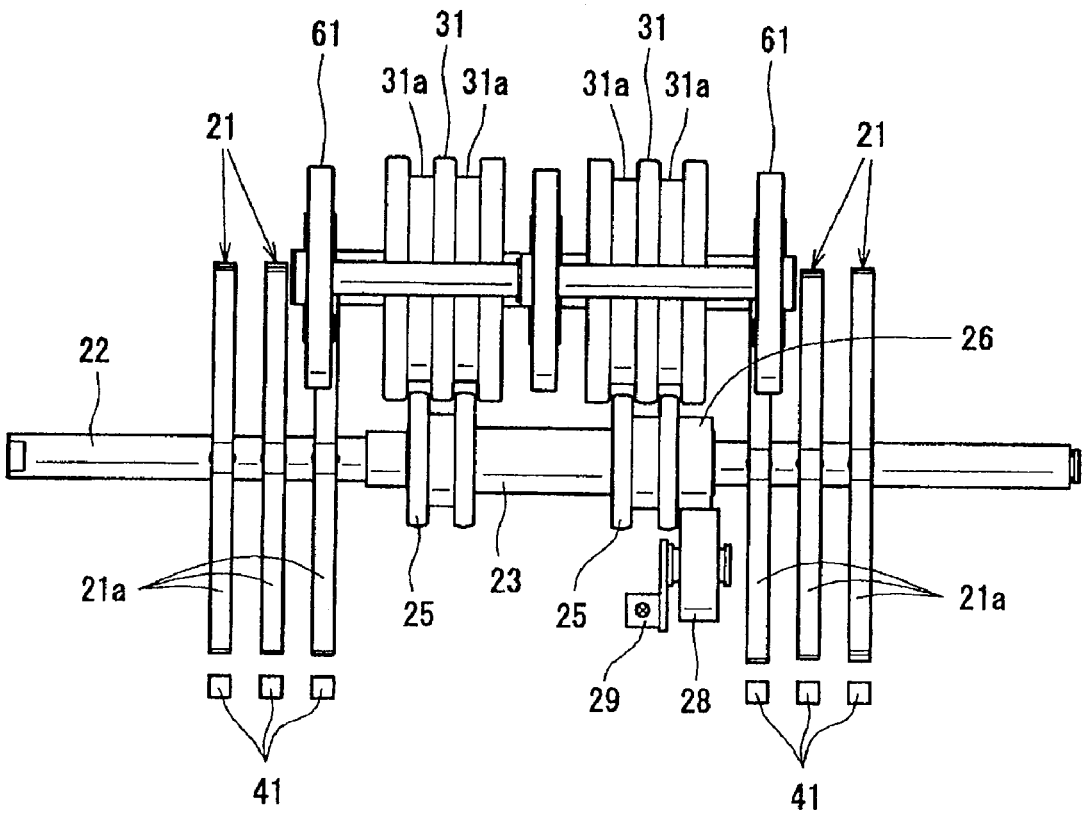
FIG. 3 is a front view showing the note accumulating/feeding apparatus.

As shown in the front view of FIG. 3, the accumulating/feeding auxiliary device 20 comprises the impellers 21, the shaft 22, a coupling 23, gate rollers 25, a gear 26, a one-way gear 28, a fixed portion 29, and accommodating covers 41.

Two gate rollers 25, 25 are provided on the shaft 22 to be opposed to the feed rollers 31.

Circumferential surfaces of the gate rollers 25 are formed to be convex in shape so as to be able to enter slightly into grooves 31*a* formed on the feed rollers 31, 31, so that the feed rollers 31 and the gate rollers 25 overlap each other.

The impellers 21, 21 serving to slap down a note at the time of accumulating processing are arranged three by three right and left six in total outside the gate rollers 25, 25. In addition, the shaft 22 accordingly functions as an impeller shaft making a shaft of the impellers 21, 21.

The impellers 21 are formed from an appropriate rubber material and bent by the accommodating covers 41 to be deformed in an accommodated state.

Figure 4:
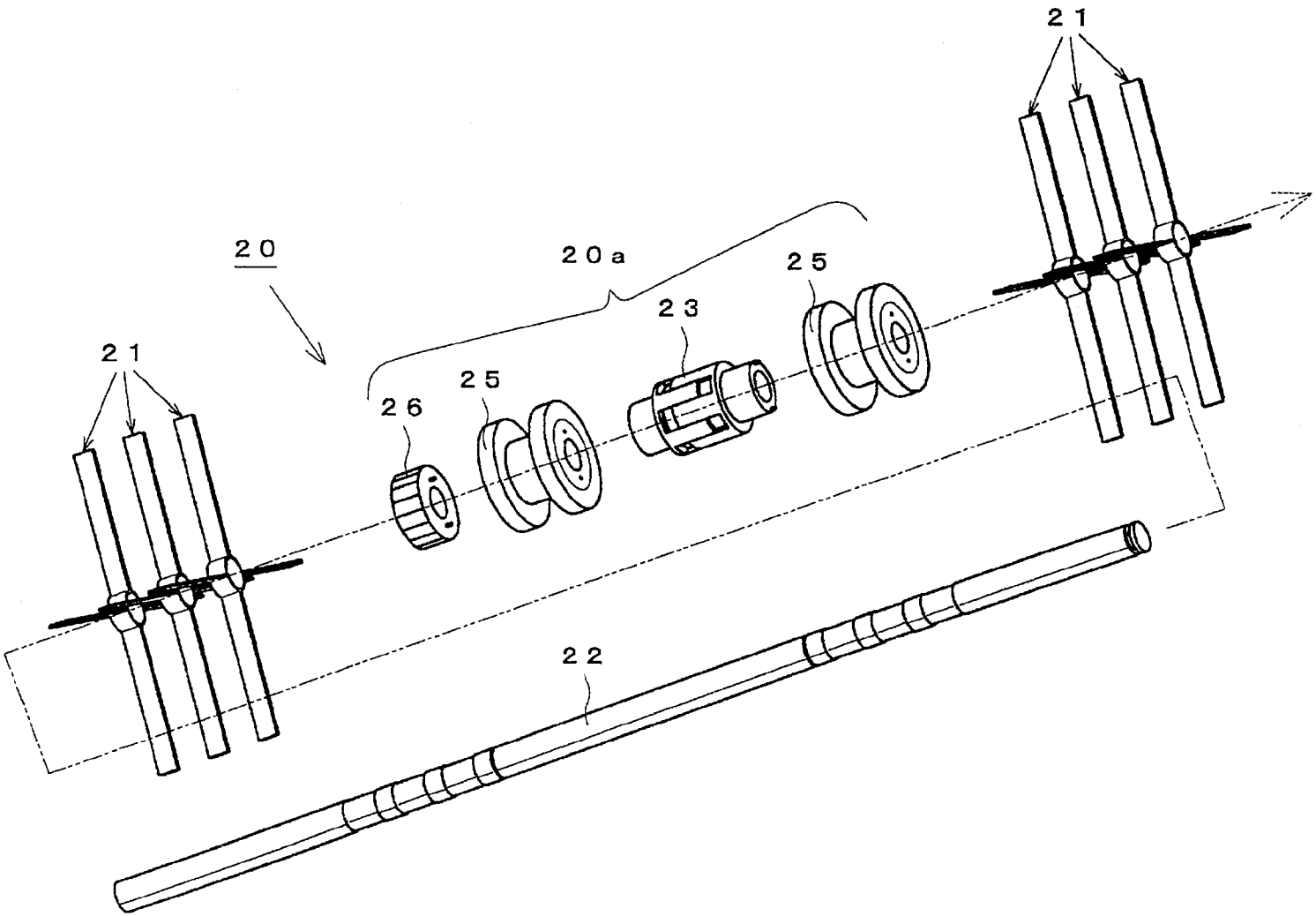
FIG. 4 is an exploded, perspective view showing the note accumulating/feeding apparatus.

As shown in the exploded, perspective view of the accumulating/feeding auxiliary device 20 in FIG. 4, the impellers 21 are configured such that four sheet-shaped rotating pieces 21*a* are provided radially at an angle of 90° relative to one another on a peripheral surface of a central cylinder.

The rotating pieces 21*a* are configured such that flat surfaces on large sides of the sheet-shape are made in parallel to an axial direction of the cylinder so as to slap down a note.

As shown in FIG. 3, the accommodating covers 41 are provided in positions below the impellers 21 to be opposed to the rotating pieces 21*a* of the impellers 21.

Here, the construction of the accumulating/feeding auxiliary device 20 is described with reference to the exploded, perspective view of the accumulating/feeding auxiliary device 20 shown in FIG. 4.

With the accumulating/feeding auxiliary device 20, the central coupling 23, the gate rollers 25, 25 on both sides thereof, and the gear 26 outside the left gate roller 25, respectively, are fitted onto the shaft 22, which is made of a metallic material, so as to rotate together. A gate section 20*a* composed of the coupling 23, the gate rollers 25, and the gear 26 is positionally fixed by interposing both sides of the gate section 20*a*, and the gate section 20*a* is thus positioned.

The impellers 21, 21 are fittingly fixed to portions of the shaft 22 outside the gate section 20*a*.

Figure 5:
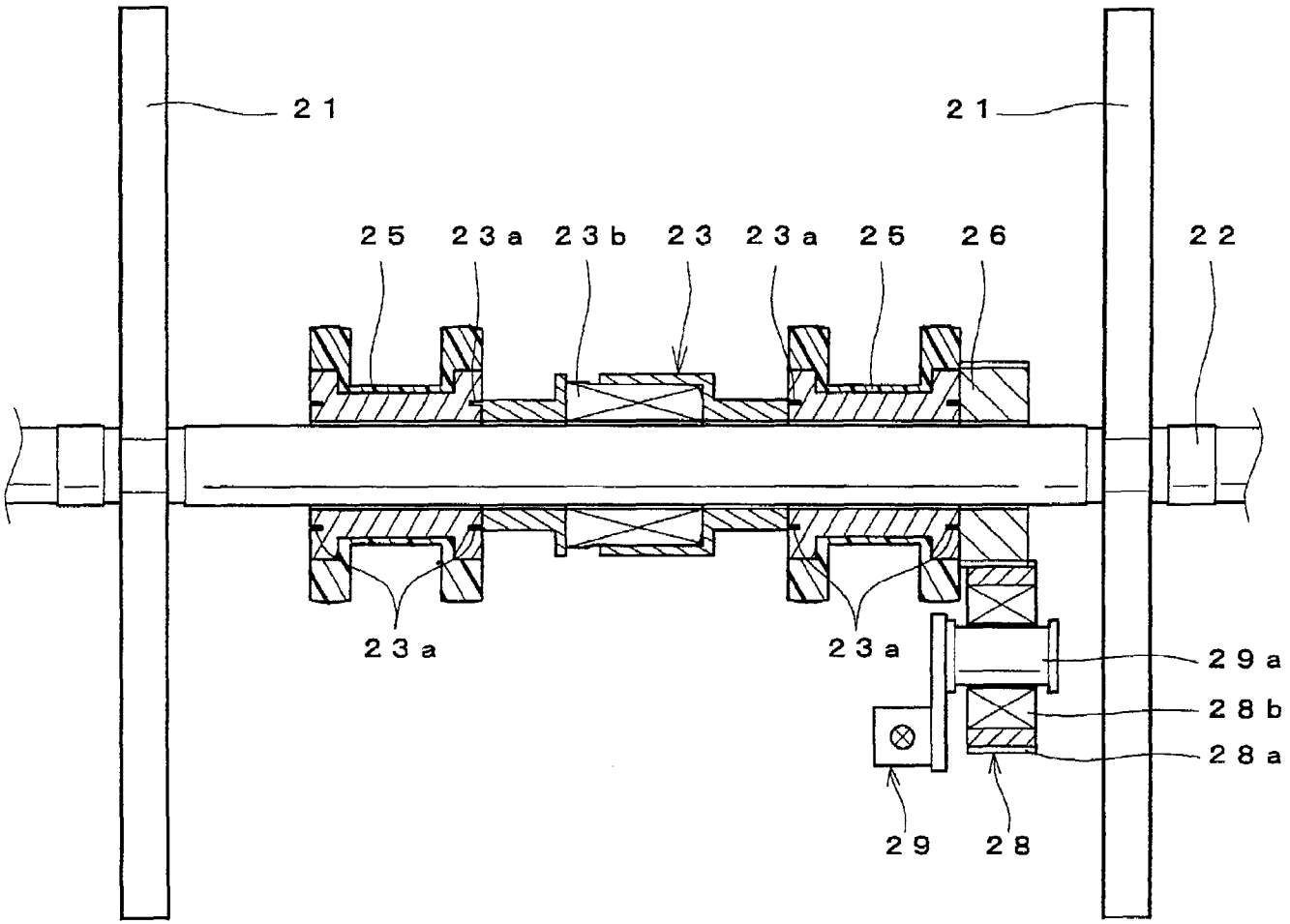
FIG. 5 is a cross sectional view showing a part of the front of the note accumulating/feeding apparatus.

The accumulating/feeding auxiliary device 20 assembled in this manner is structured as shown in the front view of FIG. 3 and in the cross sectional view of FIG. 5, so that the gate section 20*a* operates unitarily.

More specifically, the gate rollers 25 are provided on sides thereof with engagement holes (recesses) as shown in FIG. 5, and engagement projections 23*a*, respectively, provided on sides of the coupling 23 and the gear 26 are fitted into the engagement holes to connect the respective parts together. Thereby, all the parts as connected cannot rotate individually but rotate/non-rotate unitarily as the gate section 20*a*.

The coupling 23 comprises a one-way clutch 23*b* therein, so that it does not rotate in a direction of accumulation but rotates in a direction of feed. Accordingly, the gate rollers 25 unite with the shaft 22 in the direction of accumulation while the gate rollers 25 are made free from the shaft 22 in the direction of feed.

The gear 26 is coupled to the one-way gear 28 positioned therebelow. The one-way gear 28 is set in clutch directivity and born by a portion w of the fixed portion 29 so that a gear 28*a* formed on an outer peripheral surface of the one-way gear meshes with the gear 26 to provide for transmission of rotation and a one-way clutch 28*b* accommodated inside the one-way gear stops rotation in the direction of feed and allows rotation in the direction of accumulation. In addition, the fixed portion 29 is fixed to the note conveyance guide 5 (FIG. 1) for the conveyance path.

With such construction, the one-way gear 28 allows rotation of the gate rollers 25, 25 in the direction of accumulation and causes non-rotation and stoppage of the gate rollers in the direction of feed.

A one-way mechanism composed of the one-way gear 28 and the one-way clutch 28*b* allows all the parts of the accumulating/feeding auxiliary device 20 to be rotated by the shaft 22 at the time of accumulation and puts the gate section 20*a* in a non-rotating state (that is, a stopped state) at the time of feed although the impellers 21 and the shaft 22 rotate.

With such construction, the gate section 20*a* and the impellers 21 rotate at the time of the accumulating operation to enable assisting accumulation. At the time of feed, the gate section 20*a* is stopped to be able to give a frictional force so that the second note and succeeding notes are not fed from notes stacked in the accumulation space 7.

Subsequently, referring to FIG. 6 being a perspective view showing the accumulating/feeding auxiliary device 20 as viewed from obliquely rightward and downward on the front, and FIG. 7 being a perspective view showing the accumulating/feeding auxiliary device 20 as viewed from obliquely leftward and downward on the rear, an explanation will be given to the impellers 21 and the accommodating covers 41 mounted in the accumulating/feeding auxiliary device 20.

Figure 6:
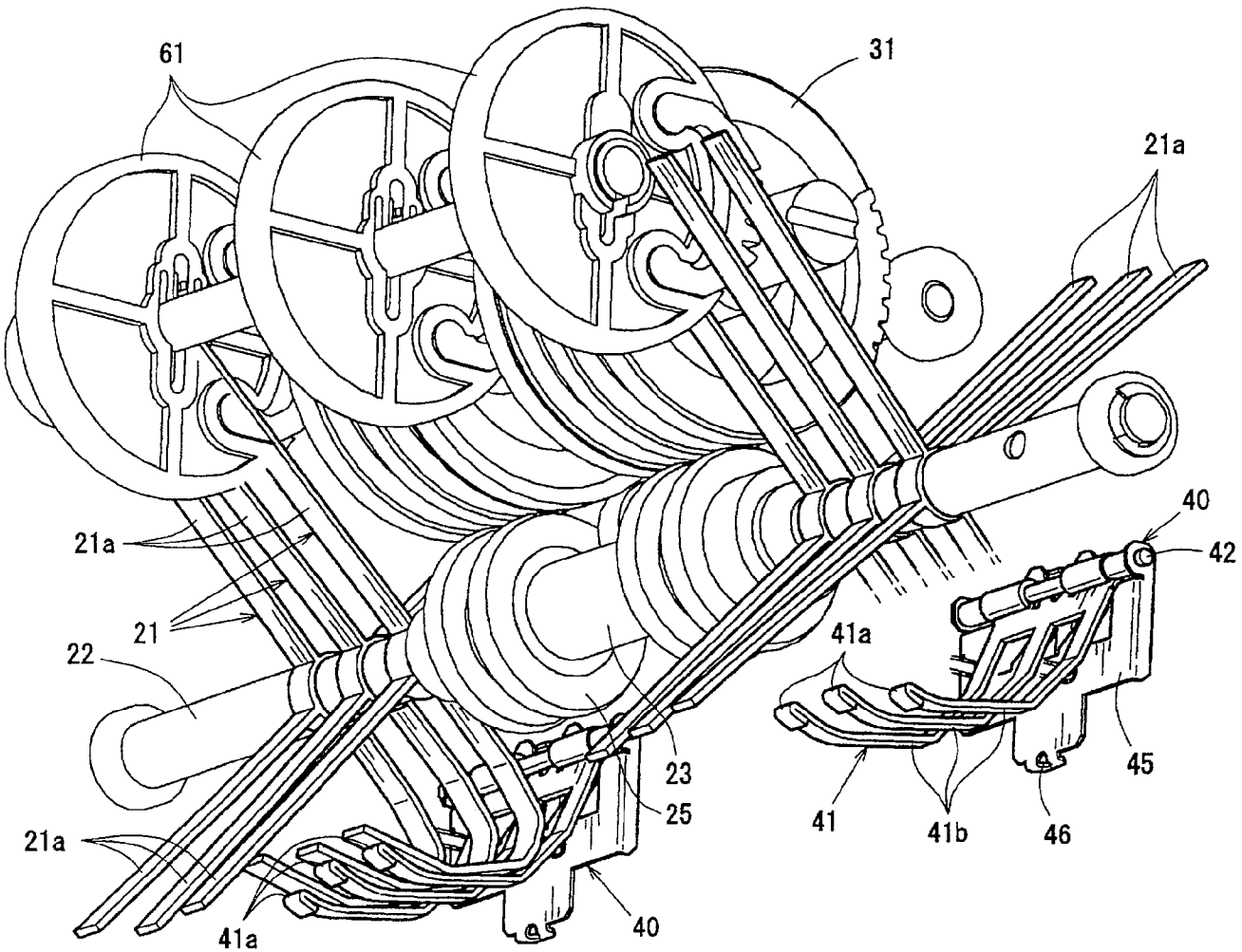
FIG. 6 is a perspective view showing the note accumulating/feeding apparatus as viewed from obliquely rightward and downward on the front.
Figure 7:
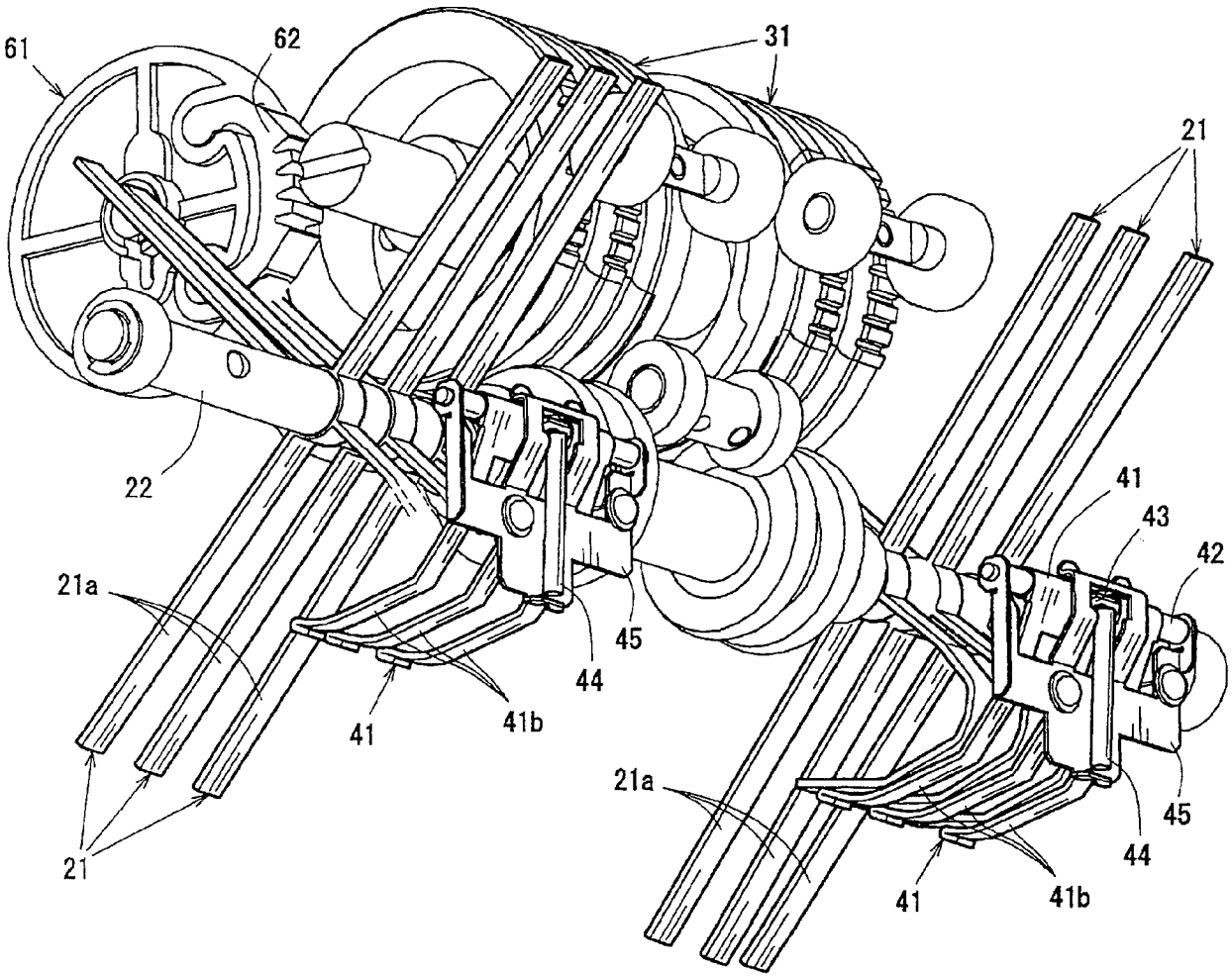
FIG. 7 is a perspective view showing the note accumulating/feeding apparatus as viewed from obliquely leftward and downward on the rear.

In addition, for the sake of easy understanding, the rotating pieces 21*a* of the three impellers 21 positioned on the right in a front view are partially omitted from illustration in FIGS. 6 and 7.

The accommodating covers 41 are formed to have a fork shape having three pawls 41*b* formed by dividing and bending a tip end thereof like a fork.

Tip ends of the respective pawls 41*b* of the accommodating covers 41 are bent 180° outwardly of the bent portions to be formed with collision protective portions 41*a* so as not to damage the rotating pieces 21*a* that collide against the tip ends at the time of accumulating processing.

Base sides of the accommodating covers 41 are pivotally supported on pivots 42 provided at upper ends of cover holding portions 45. The pivots 42 are provided in parallel to the shaft 22.

Springs 44 comprising an elastic member are provided on the rear side (an opposite side to the accommodating covers 41) of the cover holding portions 45.

The springs 44 have a lower end thereof mounted on a mount projection 46 formed on a lower end of the cover holding portion 45 and have an upper end thereof mounted on a mount projection 43 formed on the rear side of the base of the accommodating cover 41.

Figure 8A:
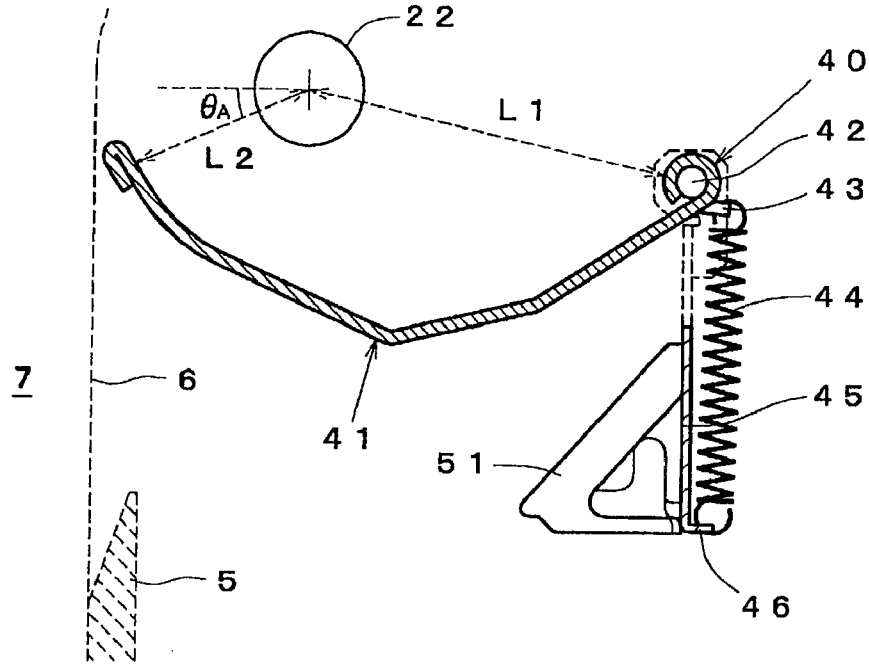
FIGS. 8A and 8B are views illustrating an operation of a rotating-piece accommodating mechanism.

As shown in a right side view illustrating an operation in FIG. 8A, the mount projection 43 is projected from a line connecting between the pivot 42 and the mount projection 46. Thereby, the principle of leverage is made use of to cause an elastic force of the spring 44 to biasingly turn the tip end of the accommodating cover 41 upward (in a direction, in which an axis of rotation of the impeller 21 is present) about the pivot 42.

The cover holding portions 45 are fixed to mounts 51 provided on the note accumulating/feeding apparatus 1 (FIG. 1) by fixing means such as screws, etc.

In addition, the mounts 51 function as latch members to latch the accommodating covers 41 so as to prevent the same from turning downwardly of predetermined positions. Thereby, the springs 44 are prevented from being extended up to an extent, in which they cannot be restored.

Also, a rotating-piece accommodating mechanism 40 is constituted by the accommodating cover 41, the pivot 42, the spring 44, and the cover holding portion 45.

With such construction, the accommodating cover 41 can be lifted upward by the elastic force of the spring 44 at the time of accumulating processing and at the time of stoppage to bring about a state, in which the rotating pieces 21*a* of the impeller 21 are accommodated, as shown in FIG. 8A.

In detail, a distance L2 from the tip end portion of the accommodating cover 41 to an axis of the impeller 21 becomes shorter than a distance L1 from that pivot, at which the accommodating cover 41 is pivotally mounted to the pivot 42, to the axis of the impeller 21 at the time of accumulating processing and at the time of stoppage.

Further, an angle θA formed between a horizontal line passing through the axis of the impeller 21 and a line connecting between the axis of the impeller 21 and the tip end portion of the accommodating cover 41 approximates 0° to bring about a state, in which the tip end portion of the accommodating cover 41 comes in front of the axis of the impeller 21.

In this state, the rotating pieces 21*a* of the impeller 21 mounted on the shaft 22 can be prevented from projecting toward (leftward in the figure) the accumulation space 7, which is most important in prevention of jam of paper in the feeding processing.

Figure 8B:
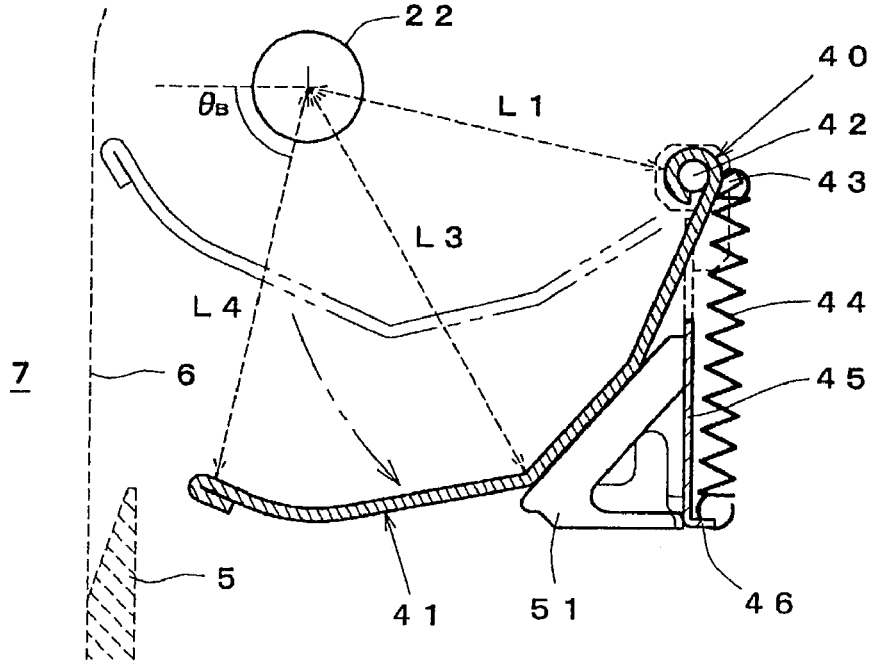

Also, at the time of accumulating processing, the accommodating cover 41 can be pushed down by torque of the rotating pieces 21*a* of the impeller 21 to turn in a state, in which the rotating pieces 21*a* are opened, as shown in FIG. 8B.

In detail, at the time of accumulating processing, the distance L1 becomes substantially equal to a distance L4 from the tip end portion of the accommodating cover 41 to the axis of the impeller 21. Further, the distance L1 also becomes substantially equal to a distance L3 from an intermediate portion of the accommodating cover 41 to the axis of the impeller 21.

Further, at this time, an angle θB formed between the horizontal line passing through the axis of the impeller 21 and a line connecting between the axis of the impeller 21 and the tip end portion of the accommodating cover 41 approximates 90° to bring about a state, in which the tip end portion of the accommodating cover 41 withdraws much to a position below the axis of the impeller 21.

In this state, the rotating pieces 21*a* of the impeller 21 provided on the shaft 22 can spread sufficiently toward (a left side in the figure) of the accumulation space 7, which is most important in slapping down a note in the accumulating processing. Further, it is also possible to prevent a situation, in which the rotating pieces 21*a* collide against the tip end portion of the accommodating cover 41 to spring back to conversely slap up succeeding notes, thus generating jam of paper.

Subsequently, referring to FIG. 9 being a view showing a cross section of a right side of the note accumulating/feeding apparatus 1, an explanation will be given to an operation controlled and executed by appropriate control means at the time of accumulating processing.

In addition, the accumulating/feeding auxiliary device 20 (FIG. 4) provided with the impellers 21 is provided in the vicinity of a connection between the accumulation space 7 and a conveyance path 70 outside (a right side in the figure) the accumulation space 7 except the rotating pieces 21*a* and peripheral surface portions of the gate rollers 25.

When notes 8 are thrown from a charging port 71, feed rollers 31 rotating clockwise (direction of accumulation) in the figure convey the notes 8 on the conveyance path 70 in the direction of accumulation to discharge the same into the accumulation space 7.

At this time, the gate rollers 25 and the impellers 21 rotate counterclockwise (direction of accumulation) in the figure and the notes 8 discharged into the accumulation space 7 are slapped down by the rotating pieces 21*a* of the impellers 21.

At this time, it is possible to surely slap down the notes 8 since a length B, by which the rotating pieces 21*a* project from the circumferential surfaces of the gate rollers 25, is set to meet the relationship (a projecting length B of the rotating pieces>a depth length C of the accumulation space−a width A of notes) with respect to a width A of notes and a depth length C of the accumulation space 7.

Here, the width A of notes is set to a minimum one among those of notes 8 of plural kinds being an object of accumulation. Also, the depth length C of the accumulation space is set to a maximum one among those of notes 8 of plural kinds being an object of accumulation.

After slapping down the notes 8, intermediate portions of or distal ends of the intermediate portions of the rotating pieces 21*a* collide against the collision protective portions 41*a* of the accommodating covers 41 to push down the accommodating covers 41 with torque of the rotating pieces 21*a*.

Thereby, the rotating pieces 21*a* rotate smoothly to be able to surely slap down those notes 8, which are successively conveyed from the conveyance path 70 and discharged into the accumulation space 7, sequentially.

In the operations described above, the rotating pieces 21*a* can surely slap down notes 8 into the accumulation space 7 to avoid collision of the notes 8 successively discharged into the accumulation space 7, thus enabling prevention of jam.

Also, setting the projecting length B of the rotating pieces makes it possible for a single note accumulating/feeding apparatus 1 to deal with plural kinds of notes having different sizes. Accordingly, it is possible not only to accumulate and feed one kind of notes but also to accumulate and feed plural kinds of notes having different sizes in a mixed state. Also, the note accumulating/feeding apparatus can also be used as one that does not perform feeding.

Subsequently, referring to FIG. 10 being a view showing a cross section of a right side of the note accumulating/feeding apparatus 1, an explanation will be given to an operation controlled and executed by appropriate control means at the time of feeding processing.

In executing the feeding processing, the elevation drive device 4 (FIG. 1) lifts the elevating plate 3.

At this time, the shaft 22 (FIG. 3) is rotated clockwise (direction of feed) in the figure to rotate the impellers 21 clockwise (direction of feed) in the figure to execute the rotating-piece accumulating processing in a state, in which the gate rollers 25 are stopped by the one-way mechanism described above.

Thereby, the rotating pieces 21*a* of the impellers 21 begin to contact at pivot portions on sides of bases thereof with the accommodating covers 41 to be accommodated therein.

In detail, the intermediate portions of the rotating pieces 21*a* collide against guides 5*a* disposed at upper ends of the grooves 6 formed on the note conveyance guide 5, so that the rotating pieces 21*a* are reduced in torque.

At this time, the intermediate portions of the rotating pieces 21*a* are deformed into a state of being bent toward a side of withdrawal, in which state the intermediate portions come into contact with guide plates 9, which are provided near to and above the pivot portions of the accommodating covers 41.

The rotating pieces 21*a* being in a bent state further contact with upper surfaces (inner sides) of the accommodating covers 41, in which state the rotating pieces rotate to be deformed by the bias of the springs 44 into a state, in which portions of the rotating pieces 21*a* near to the bases thereof are bent toward the side of withdrawal.

In this manner, the rotating pieces 21*a* are accommodated toward the rotating shaft and prevented from projecting into the accumulation space 7.

As the elevating plate 3 ascends, notes 8 push up the pickup rollers 61, and when a detected body 63 provided on the pickup rollers 61 is detected by a sensor 64, which serves as detection means, ascent of the elevating plate 3 is stopped and feed of the notes 8 is started.

When feed is carried out, the pickup rollers 61 are rotated counterclockwise (direction of feed) in the figure to cause the projections 62 to feed an uppermost note 8 onto the conveyance path 70 from the accumulation space 7.

At the time of such feed, the gate rollers 25 put in a stopped state prevent a second note 8 and succeeding notes from be taken out. The feed rollers 31 are rotated counterclockwise (direction of feed) in the figure to convey the notes 8 one by one on the conveyance path 70 to discharge the same from a discharge port 72.

In the operations described above, it is possible to prevent a situation, in which in lifting notes 8 up to a position affording feed at the time of feeding processing, the rotating pieces 21*a* project into the accumulation space 7 to cause jam to make it impossible to lift the notes 8 up to a level required for feed.

Also, since at the time of feeding a note 8 the rotating pieces 21*a* rotate in the direction of feed while being accommodated by the accommodating covers 41, the rotating pieces do not interfere with feed of the note 8 and can be prevented from making the cause for taking out a second note and succeeding notes.

By virtue of the note accumulating/feeding apparatus 1 described above, notes having different sizes can be dealt with by a single note accumulating/feeding apparatus 1. That is, notes having a maximum size as set can be accumulated and fed in a state shown in the figure.

Figure 9:
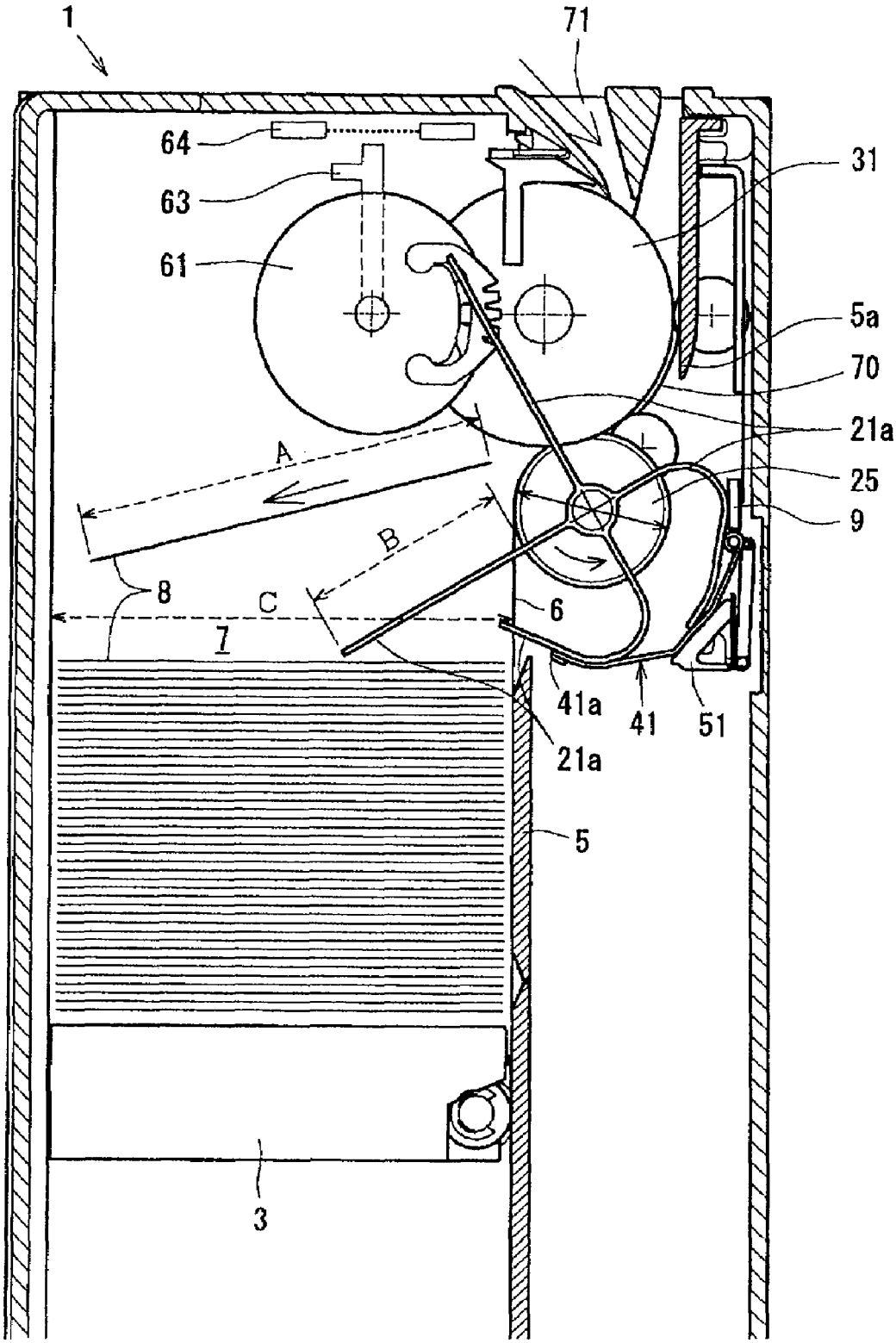
FIG. 9 is a view showing a cross section of a right side of the note accumulating/feeding apparatus at the time of an accumulating operation.
Figure 10:
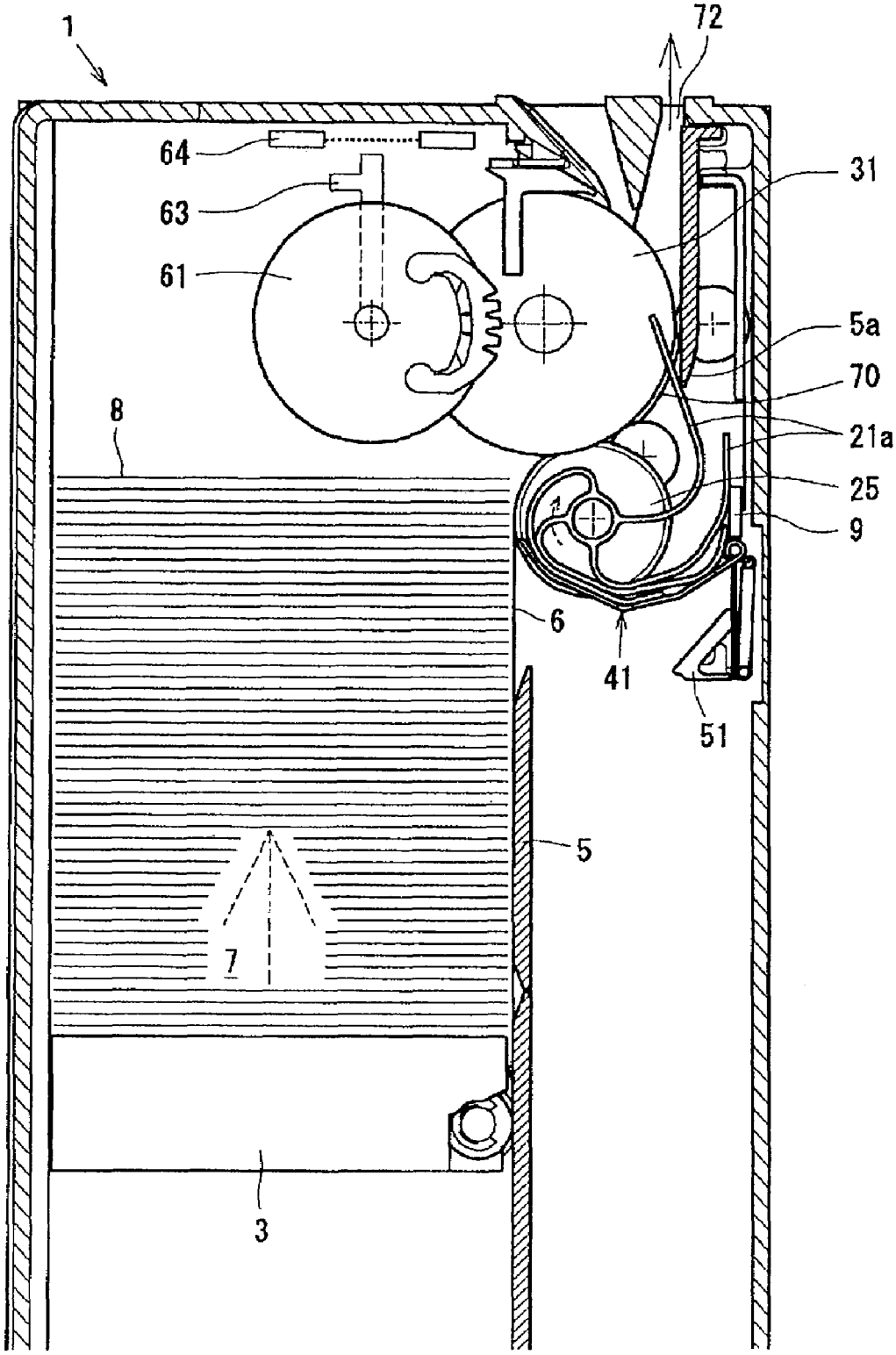
FIG. 10 is a view showing a cross section of the right side of the note accumulating/feeding apparatus at the time of a feeding operation.

For notes sized to be maximum or smaller, it suffices that an appropriate member be provided on an opposite side of the accumulation space 7 to the note conveyance guide 5, that is, a left side in FIGS. 9 and 10. Thereby, notes 8 accumulated in the accumulation space 7 can be aligned on a side of the note conveyance guide 5 and accumulation/feed can be performed stably.

Also, in mixing and accumulating notes 8 having different sizes, it is possible to surely slap down notes 8 having a small width even when the notes 8 are discharged to a back side (the left side in FIGS. 9 and 10) of the accumulation space 7 since the projecting length B of the rotating pieces 21*a* is sufficiently long.

Taking, for example, Euro notes as an object, a 5-Euro note has a size of 120×62 mm and a 500-Euro note has a size of 160×82 mm, so that a 5-Euro note has a width about 0.76 times a width of a 500-Euro note and thus there is a difference of 20 mm in length.

Since the rotating pieces 21*a* secure a sufficient length accommodating notes having a small width as described above, it is possible to surely slap down whichever of a 5-Euro note and a 500-Euro note.

In addition, while the accommodating covers 41 are formed to have a shape of the teeth of a comb, they may be formed from a plate-shaped body having a shape, which fills up between the respective teeth (pawls 41*b*), for example, a shape, which is rectangular as viewed in plan view and arcuate as viewed in side view. In this case, a planar surface of the plate-shaped body can accommodate therein the rotating pieces 21*a* of the three impellers 21.

Also, while the impellers 21 are arranged three by three right and left at intervals in a manner to make the rotating pieces 21*a* have a shape of the teeth of a comb as viewed in front view, impellers 21 provided with rotating pieces 21*a* having a shape of the teeth of a comb as viewed in front view may be arranged one by one right and left.

Also, while the impellers 21 are juxtaposed so that all the rotating pieces 21*a* are put in the same phase, they may get out of position alternately so that the rotating pieces are put in different phases.

Also, while the four rotating pieces 21*a* of the impellers 21 are provided at 90° intervals so as to have a shape of a cross as viewed in side view, they may be formed and provided at appropriate intervals such that two rotating pieces are formed at 180° intervals, or three rotating pieces are formed at 120° intervals, or only one rotating piece is provided.

Also, while the rotating pieces 21*a* and the pawls 41*b* are configured to have the same width and to be the same in number, the pawls 41*b* may have a larger width than that of the rotating pieces 21*a*. Thereby, the pawls 41*b* can further surely accommodate therein the rotating pieces 21*a* to prevent the rotating pieces 21*a* from becoming liable to bent laterally due to secular change to slip down from the pawls 41*b* at the time of feeding processing.

Also, while a simple construction composed of the pivot 42 and the spring 44 configures the accommodating covers 41 to make the same movable, drive means such as solenoid, motor, etc. may be adopted to turn or vertically move the accommodating covers 41.

In this case, it suffices that appropriate control means cause the drive means to move the accommodating covers 41 to an opened side (downward in FIGS. 9 and 10) at the time of accumulating processing and to move the accommodating covers 41 to an accommodated side (upward in FIGS. 9 and 10) at the time of feeding processing.

Also, drive means such as solenoid, motor, etc. for the shaft 22 may be adopted to horizontally move the accommodating covers 41. In this case, it suffices that driving be made to bring about a state, in which the rotating pieces 21*a* of the impellers 21 go between the pawls 41*b* of the accommodating covers 41 at the time of accumulating processing and to bring about a state, in which the rotating pieces 21*a* of the impellers 21 are accommodated by the pawls 41*b* of the accommodating covers 41 at the time of feeding processing.

Also, while the outer pawls 41*b* of the accommodating covers 41 are smaller in length than the middle pawl, all the three pawls may be set to have the same length. Also, the accommodating covers 41 may be formed from a single plate, in which gaps between the three pawls 41*b* are filled up.

Also, while the impellers 21 are provided three by three right and left, various configurations may be adopted, in which impellers are provided one by one right and left, or a single impeller is provided centrally. In this case, in order to accommodate the rotating piece or pieces 21*a* of the impeller or impellers 21, it suffices that the accommodating cover or covers 41 or the pawl or pawls 41*b* may be provided corresponding to a position or positions, in which the rotating piece or pieces 21*a* are arranged.

Also, while the note accumulating/feeding apparatus 1 is configured to include a vertical-type storage section to allow notes in the accumulation space 7 to fall and to stack notes in a horizontal position, a configuration may be adopted to include a horizontal-type storage section to make notes vertical in the accumulation space 7 to stack the same laterally.

In this case, it suffices that respective constituents be arranged in the same manner as in the case where the note accumulating/feeding apparatus 1 falls sideways toward the front.

Also, in this case, the ascending action of the elevating plate 3 corresponds to an action of movement toward the pickup rollers 61, and the descending action of the elevating plate 3 corresponds to a reverse action, that is, an action, in which the elevating plate 3 is moved in a direction away from the pickup rollers 61.

With such construction, it is possible to accumulate long notes without a trouble and to mix and accumulate notes having different sizes even in the horizontal-type note accumulating/feeding apparatus 1, in which notes as thrown-in are stacked and stored laterally while being in a vertical position.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A paper sheet accumulating/feeding apparatus including an accumulating unit that accumulates a paper sheet or sheets, an accumulating/feeding unit arranged between a paper sheet conveyance path outside the apparatus and the accumulating unit to perform a storage processing and a feeding processing on a paper sheet or sheets, and a conveyance guide defining a surface of said accumulating unit facing said accumulating/feeding unit, the accumulating/feeding unit comprising a rotating member including one or more pieces, which spread radially from an axis thereof and are made of a member, at least a part of which is flexible, as the rotating member rotates at the time of accumulating processing, the rotating member slapping the paper sheet in a direction, in which the paper sheet is accumulated in the accumulating unit, to accumulate the paper sheet, and a guide member that guides the one or more pieces to suppress radial spread of the one or more pieces at the time of feeding processing, said conveyance guide having grooves allowing the one or more pieces to project into said accumulating unit.

2. A paper sheet accumulating/feeding apparatus according to claim 1, wherein the guide member is configured to flex the one or more pieces along the axis as the rotating member rotates, thus suppressing the radial spread.

3. A paper sheet accumulating/feeding apparatus according to claim 1, further comprising a movable holding unit that movably holds the guide member in relation to the rotating member.

4. A paper sheet accumulating/feeding apparatus according to claim 3, wherein the movable holding unit holds the guide member so that the guide member approaches the axis of the rotating member at the time of feeding processing and separates therefrom at the time of accumulating processing.

5. A paper sheet accumulating/feeding apparatus according to claim 3, wherein the movable holding unit comprises a bias portion to bias the guide member toward the rotating member and a brake portion to reduce torque of the one or more pieces at the time of feeding processing, and holds the guide member to allow the same to be moved outside the rotating member by torque of the one or more pieces of the rotating member.

6. A paper sheet accumulating/feeding apparatus according to claim 1, wherein the guide member is formed from a plate-shaped body curved or bent substantially arcuately with a side thereof toward the rotating member being concave.

7. A paper sheet accumulating/feeding apparatus according to claim 1, further comprising an elevating base provided in the accumulating unit to be able to load the paper sheet or sheets to ascend and descend, and wherein the rotating member is rotated in a direction of feed to allow the one or more pieces of the rotating member to be stored when the elevating base acts to ascend.

8. A paper sheet accumulating/feeding apparatus according to claim 1, wherein the accumulating/feeding unit comprises a gate roller that conveys and guides the paper sheet or sheets, and a length, by which the one or more pieces project from a circumferential surface of the gate roller, is smaller than a length obtained by subtracting a length of that paper sheet, which is shortest among paper sheets expected to be stored, from a depth length of an accumulation space of the accumulating unit.

* * * * *